United States Patent [19]

Bowley

[11] 4,099,281

[45] Jul. 11, 1978

[54] NAVIGATIONAL BUOY

[75] Inventor: Wallace W. Bowley, Stafford Springs, Conn.

[73] Assignee: Hydra Corporation, Boston, Mass.

[21] Appl. No.: 730,670

[22] Filed: Oct. 7, 1976

[51] Int. Cl.[2] ..... B63B 21/52

[52] U.S. Cl. ..... 9/8 R; 61/53.6; 114/294

[58] Field of Search ..... 9/8 R, 8 P, 9; 114/230, 114/293, 294, 295, 296, 300; 61/53.6; 52/155

[56] References Cited

U.S. PATENT DOCUMENTS

| | | | |
|---|---|---|---|
| 2,381,394 | 8/1945 | Beach | 114/230 |
| 2,497,377 | 2/1950 | Swann et al. | 61/53.6 |
| 3,270,469 | 9/1966 | Debiton | 61/53.6 |
| 3,605,147 | 9/1971 | Shelton | 9/8 R |
| 3,614,869 | 10/1971 | Flory et al. | 9/8 P |
| 3,800,347 | 4/1974 | Zuurbier | 9/8 R |

FOREIGN PATENT DOCUMENTS

| | | | |
|---|---|---|---|
| 144,362 | 3/1954 | Sweden | 9/8 R |

*Primary Examiner*—Trygve M. Blix
*Assistant Examiner*—Charles E. Frankfort
*Attorney, Agent, or Firm*—Paul J. Cook

[57] ABSTRACT

A navigational buoy is provided having a buoy and an inflatable anchor. The buoy and anchor are connected by a hollow stem that is itself flexible or is rigid and is connected to the anchor by a flexible elastomeric bearing. The stem is adapted to provide fluid communication with the anchor so that the anchor can be inflated after being positioned below the sea bottom. The flexibility of the stem is regulated by the materials used to form the stem, solid or liquid fillers in the stem and pneumatic pressure in the stem.

2 Claims, 3 Drawing Figures

NAVIGATIONAL BUOY

BACKGROUND OF THE INVENTION

This invention relates to a navigational buoy construction including a buoy, an inflatable anchor and an inflatable flexible stem for connecting the buoy and the anchor.

Buoys are used as markers in the water to serve as navigational guides for seamen. It is essential that the buoys be capable of being positioned accurately and that they maintain their position in order to preserve their integrity as navigational guides. Presently, navigational buoys comprise a floating buoy attached to an anchor by a cable or a chain. In order that the buoy be capable of withstanding the time-varying load exerted on it by the sea and wind, it has been found necessary to provide a length of chain or cable in the order of about ten times the water depth in which the anchor is placed. While this construction satisfies the mechanical requirements of a navigational buoy, it is undesirable in that it permits the buoy to move in a relatively wide watch circle having a diameter of about fourteen times the water depth at which the bupoy is placed thereby reducing the reliability of the buoy position. Additional nonreliability results from shifting of the anchor due to wave forces. It has been proposed to provide permanent anchors comprising heavy weights in the order of twenty-five tons to prevent anchor shifting and to permit tighter watch circles. However, since it is necessary to replace or inspect the mooring line periodically, divers or sophisticated remotely controlled underwater devices are needed to attach, detach or inspect the mooring line.

It would be highly desirable to provide a navigational buoy which, when positioned, has a tight watch circle and which requires little or no maintainence.

SUMMARY OF THE INVENTION

This invention provides a navigational buoy having an inflatable anchor and a buoy connected by an inflatable stem which provides support and positioning of the buoy at or near the water line. The stem is itself flexible or is rigid and connected to the anchor by a flexible elastomeric bearing. The stem per se or the stem-elastomeric bearing construction is sufficiently flexible to distribute the time-varying load exerted by water and wind along the length of the stem and to avoid undue concentration of the water forces at either the stem-buoy connection or the stem-anchor connection. The stem is hollow along its length to provide fluid communication with the interior of the anchor and to permit inflation of the anchor after it is positioned below the sea bottom. After the stem and anchor are inflated, a portion or all of their interior can be filled with a material such as sea water, sand or concrete to improve anchor strength and to adjust flexibility of the stem. The remaining hollow portion of the stem can be pressurized to provide further control of stem flexibility.

GENERAL DESCRIPTION OF THE DRAWINGS

DETAILED DESCRIPTION OF THE INVENTION

This invention is based upon the concept that a buoy can be connected to a permanent anchor by means of a flexible stem or rigid stem-flexible elastomeric bearing construction with sufficient mechanical strength to support the buoy at, near or above the water surface while providing sufficient flexibility to bend without fracture under the time-varying load exerted by wind and water such as tide, current and wave forces. The degree of flexibility of the flexible stem or of the stem-bearing construction is controlled so that the change in its radius of curvature dictated by the time-varying load on it allows the buoy to remain above the water surface and the forces on the stem are distributed along its length rather than allowing the forces to concentrate at the stem-buoy connection or the stem-anchor connection.

The navigational buoy comprises a stem and an anchor of integral construction which includes a flexible elastomeric bearing when the stem is rigid. The buoy can be formed integrally with the stem or can be formed separately in a mode with means for attaching it to the stem. The flexible stem and anchor is formed from a material which can be inflated to a form having the desired strength and flexibility such as from a fiber glass-polyester or epoxy composite or from synthetic rubber which can be reinforced with fibers such as glass fibers either in a woven or nonwoven net form or as fibers per se or with a metal helical spring which is incorporated within the walls of the stem or of the stem and anchor. The flexibility of the stem is controlled by the amount, distribution and type of reinforcing material or fiber material incorporated within the stem so that the stem flexibility can be adapted for use in a wide variety of water environments where the average time-varying load caused by water and wind can vary widely. The rigid stem also is hollow and can be formed of reinforced concrete or from metal. Since the stem itself is flexible or is rendered effectively flexible by the bearing, the loads on the stem will cause the buoy to oscillate but in a watch circle having a smaller radius than that experienced with navigational buoys utilizing a chain or cable connection. Since the stem is flexible or is effectively rendered flexible, it can bend and return to the upright position under the water and wind forces. Furthermore, since the stem has a regular cross-section in the horizontal plane, e.g. circular, hexagonal or the like, it allows easy bending in any direction without a preferential direction of bending and thereby is rendered selfcleaning in water. In one aspect, the spacing and density of the fibers in the fiber-reinforced stem as well as selected preload tension of the fibers can be utilized to form a stem that is bent preferentially in one direction from the vertical so that, when it is placed in a current having a constant flow in one direction, the stem is positioned in an essentially vertical position in the water.

Figure 1:
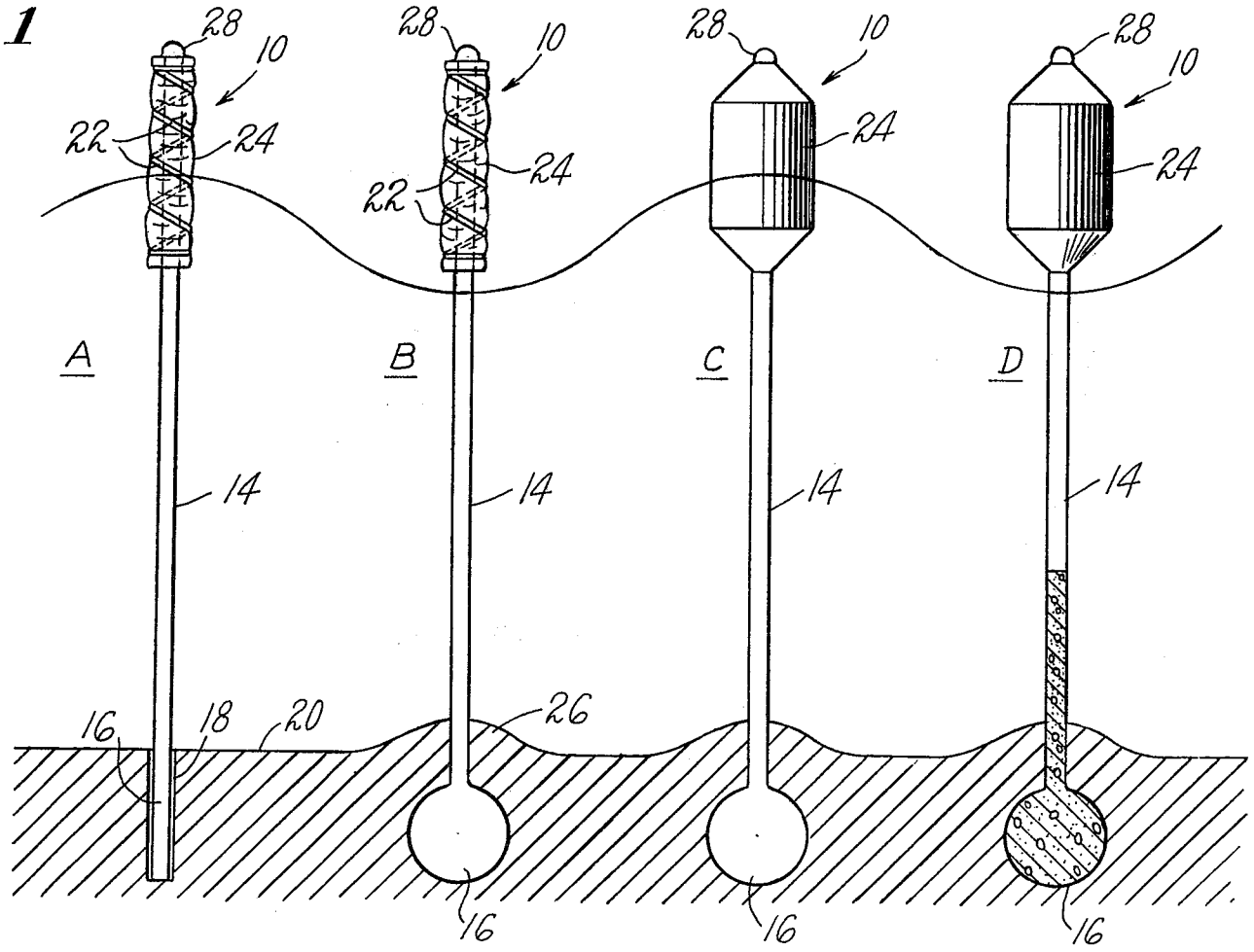
FIG. 1 shows the buoy of this invention and represents a series of steps for its positioning in water.

Reference is made to the accompanying drawings. Referring to FIG. 1, the navigational buoy 10 comprises a buoy 24 attached to the top portion of a stem 14 and an anchor 16 integrally formed with the stem 14. In position A, the anchor 16 is placed in a hole 18 in the sea bottom 20 and the buoy 24 is secured to the stem 14 by being formed integrally therewith and is prevented from being inflated by rope or metal band which is tightly wrapped around it. In position B, the anchor 16 is inflated to fill the hole 18 and to compress the portion of the sea bottom 26 which surrounds the anchor. The anchor 16 is inflated by pneumatic pressure applied through the hollow stem 14 by any suitable connection at or near the top portion 28 of the stem 14. Since the buoy 24 is secured by rope 22 while the anchor 16 is inflated, the buoy does not inflate in this step. In position C, the buoy 12 is inflated by removing the securing rope 22 and applying pneumatic pressure through the stem 14, the interior of which is in fluid communication with the interior of the buoy 24. In position D, the interior of anchor 16 and a portion of the stem 14 is filled with a solid or liquid material such as sea water or concrete in order to add weight to the anchor and to adjust the flexibility and damping characteristics of the stem 14 as desired. When in position D, the navigational buoy is suitable as a navigational aid.

Figure 2:
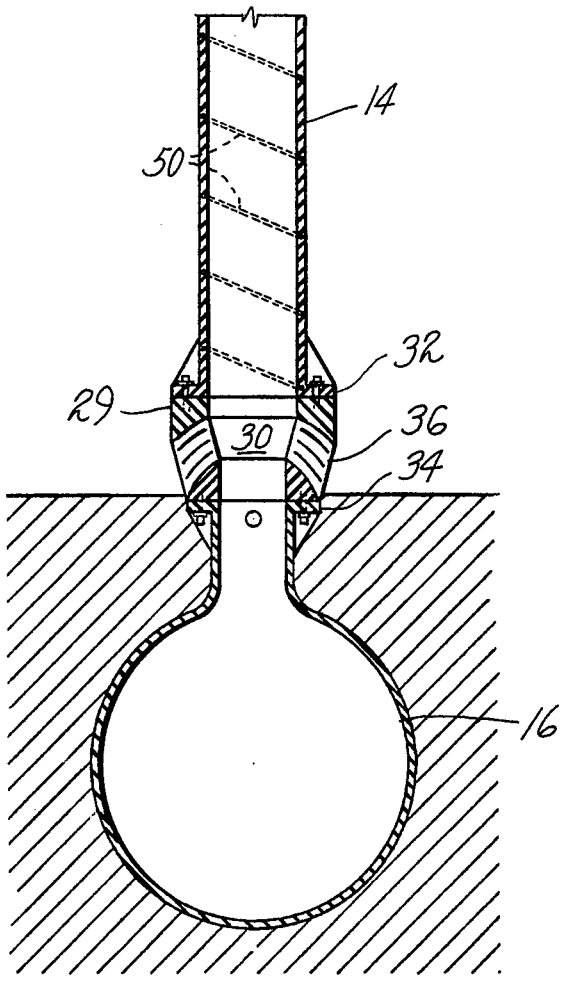
FIG. 2 is a detailed view of the navigational buoy construction which includes an elastomeric bearing.

Referring to FIG. 2, an alternative means for making the stem-anchor connection is shown. Both the stem 14 and anchor 16 are integrally connected to elastomeric bearing 29. The stem 14 is connected to bearing 29 in a manner to maintain the interior of the stem 14 and the interior 30 of bearing air tight. The stem 14 is secured to bearing 29 by means of bolts extending through flange 32 which extends around the circumference of stem 14. Similarly, the anchor 16 is connected to bearing 29 in a manner to maintain the interiors of stem 14 and bearing 29 air tight. The anchor 16 is secured to bearing 29 by means of bolts extending through flange 34 which extends around the circumference of anchor 16. Bearing 29 is formed of a flexible strong material such as rubber or high molecular weight synthetic polymer and is provided with metal spacers 36 which extend around all or a portion of the bearing circumference and are located within the bearing wall. In this embodiment, the stem 14 can be flexible or rigid such as by being formed from reinforced concrete or metal.

Figure 3:
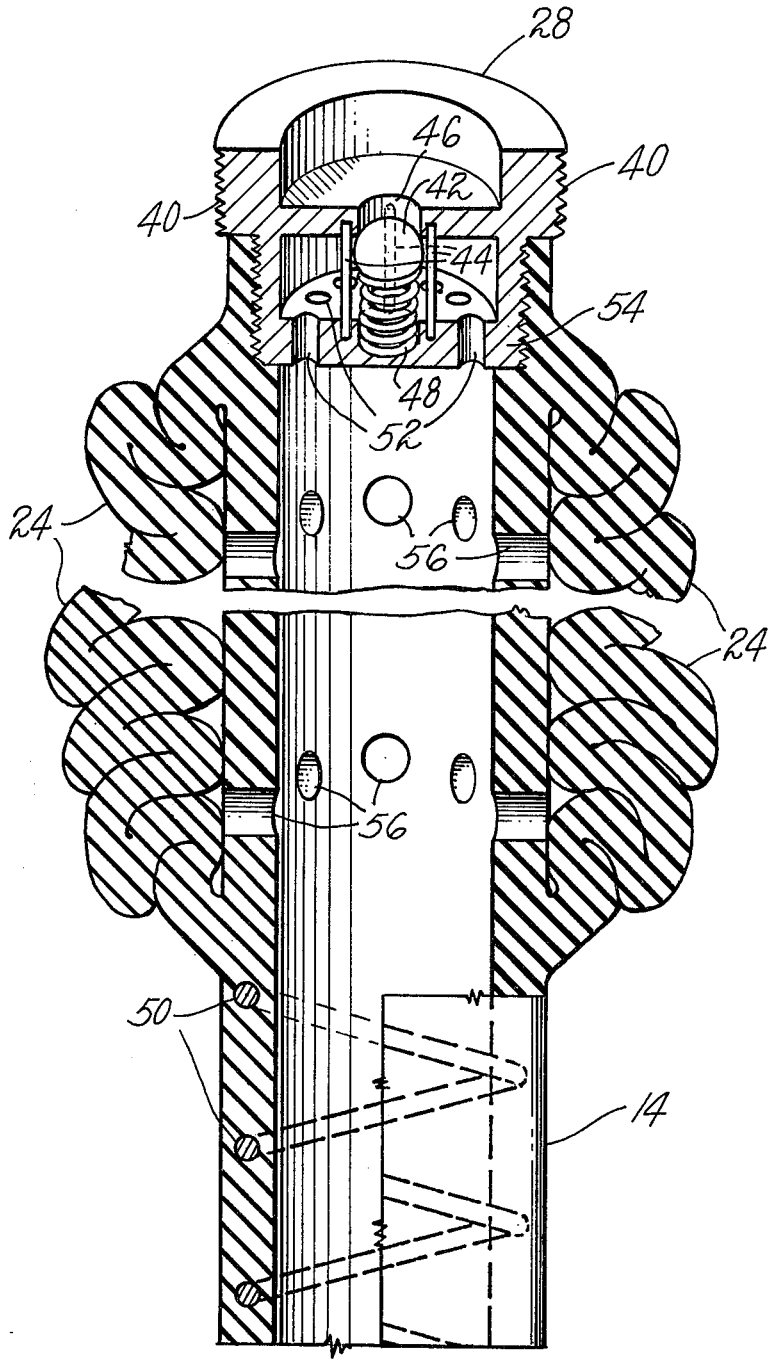
FIG. 3 is a cross-sectional view of a suitable buoystem construction adapted to permit buoy inflation.

Referring to FIG. 3, the top of the stem 14 is provided with threads 40 for securing the threaded conduit (not shown) which serves to deliver gas or filler material to the interior of the stem 14. The stem is provided with a ball check valve comprising a ball 42 and a seat comprising a plurality of shafts 44 positioned to retain the ball 42 adjacent inlet 46. The ball 42 is positioned on springs 48 to maintain inlet 46 closed by ball 42 when either filler or gas is not being introduced into stem 14. As shown, the stem 14 is provided with a metal spring 50 which is formed integrally with the wall of stem 14. When rope 22 (see FIG. 1) is removed and pneumatic pressure applied through inlet 46, the gas passes through the holes 52 in plate 54 and holes 56 in stem 14 and into the interior of buoy 24 to inflate it. When application of pneumatic pressure ceases, ball 42 closes inlet 46 to provide a pneumatic seal so that the pressure in stem 14 and buoy 24 is maintained superatmospheric. If desired, a positive closed valve can be additionally provided for gas tight security over long periods.

I claim:

1. A navigational buoy which comprises an inflatable buoy and an inflatable anchor connected by a stem comprising a hollow member adapted to provide fluid communication with the interior of said anchor and said buoy, said stem having sufficient mechanical strength to support said buoy and means for rendering said stem sufficiently flexible to withstand time-varying loads exerted by wind and water, said means comprising a flexible material for forming said stem.

2. The navigational buoy of claim 1 wherein the anchor and at least a portion of the stem are filled with a liquid or solid filler.

* * * * *